US007037394B2

(12) United States Patent
Christensen et al.

(10) Patent No.: US 7,037,394 B2
(45) Date of Patent: May 2, 2006

(54) METHOD AND APPARATUS FOR MANUFACTURING A DRYFORMED FIBROUS WEB

(75) Inventors: John Hardy Mosgaard Christensen, Egå (DK); Helmut Erwin Schilkowski, Malling (DK)

(73) Assignee: Scan-Web I/S, Risskov (DK)

( * ) Notice: Subject to any disclaimer, the term of this patent is extended or adjusted under 35 U.S.C. 154(b) by 0 days.

(21) Appl. No.: 09/879,815

(22) Filed: Jun. 13, 2001

(65) Prior Publication Data

US 2002/0066517 A1 Jun. 6, 2002

Related U.S. Application Data

(63) Continuation of application No. 08/669,472, filed as application No. PCT/DK95/00011 on Jan. 6, 1995, now abandoned.

(30) Foreign Application Priority Data

Jan. 7, 1994 (DK) ..... 0027/94

(51) Int. Cl.
*B32B 31/12* (2006.01)

(52) U.S. Cl. ..... 156/78; 156/62.2; 264/122; 264/128; 427/394; 427/397

(58) Field of Classification Search ..... 156/62.2, 156/78; 264/122, 128; 427/394, 397
See application file for complete search history.

(56) References Cited

U.S. PATENT DOCUMENTS

| | | | | |
|---|---|---|---|---|
| 3,901,240 | A | 8/1975 | Hoey | |
| 3,903,890 | A | 9/1975 | Masek et al. | |
| 3,922,462 | A | 11/1975 | Katz et al. | |
| 4,211,227 | A * | 7/1980 | Anderson et al. | 604/366 |
| 4,292,271 | A | 9/1981 | Buob et al. | |
| 4,301,573 | A * | 11/1981 | Gunter et al. | 19/200 |
| 4,348,251 | A | 9/1982 | Pauls et al. | |
| 4,362,781 | A | 12/1982 | Anderson | |
| 4,385,954 | A | 5/1983 | Pauls et al. | |
| 4,423,184 | A * | 12/1983 | Kopolow et al. | 525/57 |
| 4,562,097 | A * | 12/1985 | Walter et al. | 427/209 |
| 4,612,226 | A * | 9/1986 | Kennette et al. | 428/131 |
| 4,869,771 | A | 9/1989 | LeVan | |
| 4,927,582 | A * | 5/1990 | Bryson | 264/113 |
| 5,122,919 | A * | 6/1992 | Takemae et al. | 360/133 |
| 5,128,082 | A * | 7/1992 | Makoui | 264/112 |

(Continued)

FOREIGN PATENT DOCUMENTS

EP 0202472 A1 11/1986

(Continued)

OTHER PUBLICATIONS

"Absorbent Products Conference"—Presentation at Insight Conference Oct. 1991, Sponsored by Marketing/Technology Service, Inc. pp. XXVI-XXVI-26.

(Continued)

*Primary Examiner*—Sam Chaun Yao
(74) *Attorney, Agent, or Firm*—Browdy and Neimark, PLLC

(57) ABSTRACT

The present invention relates to webs made of cellulose fibers admixed with thermobonding fibers, wherein the web surfaces are sealed to a greater or lesser extent by adding thereto a binder in modest amounts. The binder is applied without any attempt to provide deep penetration of said binder into the web material. By applying the binder in the form of a foam, a minimum of binder is required to provide bonded webs exhibiting minimal linting.

10 Claims, 6 Drawing Sheets

U.S. PATENT DOCUMENTS

| | | | | | |
|---|---|---|---|---|---|
| 5,135,787 | A | * | 8/1992 | Bair | 428/36.1 |
| 5,225,242 | A | | 7/1993 | Frankosky et al. | |
| 5,415,717 | A | * | 5/1995 | Perneborn | 156/276 |
| 5,425,907 | A | | 6/1995 | Gross et al. | |
| 5,506,026 | A | | 4/1996 | Iwata et al. | |
| 5,552,169 | A | * | 9/1996 | Kannankeril et al. | 426/107 |
| 5,607,750 | A | * | 3/1997 | Liou | 428/172 |
| 5,618,364 | A | * | 4/1997 | Kwok | 156/62.8 |
| 5,795,439 | A | * | 8/1998 | Euripides et al. | 162/100 |

FOREIGN PATENT DOCUMENTS

| | | | |
|---|---|---|---|
| EP | 0 743 995 | B1 | 7/1998 |
| EP | 0 463 716 | B1 | 6/1999 |
| WO | WO 95/18886 | A1 * | 7/1995 |

OTHER PUBLICATIONS

Nonwovens Markets, Sep. 7, 1990, vol. 5, No. 18.

The Super Site Ultra Thin Air-Laid Diaper Production, "Air-Laid Baby Diaper Five Layer Composite"—Copy of reprint Presented at Insight Conference 1999. (It is noted that this paper only contains one page even though it is stated p. 1 of 2).

2nd Internaitonal Pira Conference Material—"New Technologies and Multilayer Structures", May 14-16, 1991, vol. 2.

Brochure from M&J, "The M&J Fiber Dosing System".

Carroll, John H., "The Air-Laid Paper Industry", Mar. 17, 1993, pp. 1-8.

Contract between Merfin Hygienic Products Ltd. and Niro Separation A/S regarding "For Supply and Erection Of Dry-Forming Plant".

Dan-Web, "Air Forming Systems"—Product sheet.

Dan-Webforming International Ltd.

Jensen, Henning Skov, "Dry-forming (air laid) Technology for Pulp Based Latex and thermal-bonded Papers and Nonwovens"—Paper presented at Edana's 1998 Nordic nonwoven Symposium.

Jensen, Henning Skov, "Manufacture of Fibre Products by Dry Fibre Forming Processes"—Manuscript for the speech given during the Pira-conference.

Jensen, Henning Skov, "The Manufacture of Multiply Air-Laid Structures",—presented at New technologies in Multilayer Structures on May 14-16, 1991 at Bristol—Pira International.

Kleppe, Johanna, "Air-Laid: Care and Feeding of a Growing Market"—Sep./Oct. 1990 Nonwovens World, pp. 27-29.

Knaus, Roman, "A Survey of New Developments in Nonwoven Bonding Line" Speech given at the Insight Conference 1983.

M & J Paper Division, Brochure—"Be Sure to Choose a Strong Solution" 1989.

Mosgaard, John et al., "New Uni-web Lin in Denmark Shows Potential for Air-Forming", Mar. 1983, pp. 117-119 Pulp & Paper.

Nonwovens Markets and Fiber Structures Report, Sep. 8, 1989, pp. 1-6, vol. 4, No. 18.

Unitika, "Unitaka's Polyester Binder Fibers "Melty""—Data Sheet.

* cited by examiner

METHOD AND APPARATUS FOR MANUFACTURING A DRYFORMED FIBROUS WEB

CROSS-REFERENCE TO RELATED APPLICATIONS

The present application is a continuation in part of Ser. No. 08/669,472, filed Jul. 8, 1996 now abandoned, which is a 371 of PCT DK95/00011 filed Jan. 6, 1995, the entirety of which is hereby incorporated by reference.

FIELD OF THE INVENTION

The present invention relates to a method for manufacturing a dryformed fibrous web material based upon dryformed cellulose fibers with a suitable bonding. The present invention also relates to the web material manufactured by this process.

BACKGROUND OF THE INVENTION

Laying out of fibers for forming a web is conventionally effected by defibrating a pulp material and admixing the pulp material into an airflow, which brings the loose fibers to a distributor head above a moving, perforated forming wire. (A forming wire is a wire screen made of wires or monofilaments which cross each other in a mesh-like fashion.) Underneath this wire is a suction chamber for down suction of the fibers against the wire, where they are deposited as a coherent fibrous pulp web with a desired web thickness. The products are typically used as liquid absorbing sheets.

It is important that the dryformed pulp web be stabilized or bonded. In practice, this is achieved in two different ways, namely, by applying binder or by using binding fibers.

Binding

The pulp web is passed through a bonding station in which a suitable glue, normally of the latex type, is sprayed onto the web through a plurality of nozzles. After that, the wire is led through a tunnel over for drying the binder. Thereafter, the web is transferred to an overhead wire, against which it is fixed by suction from above, so that the underside of the web is exposed. The web is then led through or over another bonding station, where binder is correspondingly sprayed against the underside of the web. Thereafter, the web is led through a tunnel over for drying and final setting of the binder, after which the web is self supporting and can be wound up for storage or delivery This method provides sheet webs of rather high quality, but the method requires machinery which is exact. The method is thus vulnerable to irregularities in the binding stations. It is another limitation that the method is not suitable for forming thick sheet webs, as it is difficult to achieve a deep penetration of the binder, so that a relatively thick layer tends to segregate in the center plane, where bonding is weak or is completely lacking. The products typically contain about 85% cellulose fibers and about 15% binding agent. Typical weights of these products is on the order to 50–120 g/m$^2$, as heavier products easily delaminate. Furthermore, the products are not suited for containing fibers and superabsorbent fibers.

It is well known that when binder fluid is sprayed onto an airlaid web of cellulose fibers derived from wood, the binder penetration into the web can vary within certain limits. It should be noted that the binder must be sprayed onto the web, because the web prior to having binder added does not have any cohesion and does not tolerate direct contact from the application equipment. Because the cellulose fibers have a large specific surface area and a high capacity for liquid absorption, the web works as a kind of filter, and the particles of the binder tend to become absorbed in the surface of the web, particularly if the diameter of the particles is less than 0.05 mm. This means that bonded products have a tendency to delaminate at a weight of approximately 70 g/m$^2$.

In order to avoid delamination, the web can be compacted or embossed before the binder is sprayed on. The airflow through the fiber web is also increased during binder spraying. The application by means of airless atomization equipment also increases the penetration of the binder into the web considerably. The binder in this case is atomized at a pressure of from about 10 bar to about 15 bar, and particles of a size up to about 0.5 mm are "shot" into the fiber web. Nevertheless, the delamination limit for products bonded in this way is still at a product weight of only 100 to 120 g/m$^2$. Furthermore, this bonding method has the disadvantage that a large proportion of the cellulose fibers are coated with a binder film, which delays and reduces the ability of the product to absorb liquids.

Normally, products bonded by spraying followed by compacting or embossing are relatively compact, lint free, and have a relatively high durability and reasonably good absorption. These products are mostly used to make napkins, wet tissues, table cloths, kitchen towels, and the like.

Binding Fibers

In this method, a homogeneous admixture of heat actuated binding fibers, also known as thermobonding fibers, is made with cellulose fibers. The dryformed web material is fixed solely by being led through a heating zone. As to system and control, this method is more simple than the above binding method. Thick webs can be manufactured by this process, as the bonding fibers are evenly present in the outer as well as in the inner planes of the material. The weight of product may typically be 40–800 g/m$^2$, and these webs can incorporate a considerable amount of superabsorbent agent or other additives. The quality achieved by this method is fully acceptable for many different applications. The typical content of thermobonding fibers in the product is 15%. A higher content of thermobonding fibers would reduce the absorption capabilities of the product, but would also be economically unattractive.

Normally, the cellulose fibers range in lengths between 0.5 and approximately 5 mm, whereas heat thermobonding fibers are often 6 mm or longer. In practice, this results in very good bonding of the longest cellulose fibers. This means that a certain amount of dust develops in the subsequent converting process, during which the customer converts the airlaid material into end products such as hygiene and incontinence products. During this process the airlaid material is wrapped with a coverstock and other material, which prevents the insufficiently bonded cellulose fibers from leaving the product. The converting is carried out at a line speed of up to about 250 m/minute, and the thermobonded airlaid product will here be exposed to both vibration and reverse stretching. The dust which breaks loose during their influence may cause serious hygienic problems for the workers. The application of a strong exhaust system, connected to a filtration system, can solve most of these problems, but this is an expensive installation, as the air which is sucked out of the production area must be replaced by conditioned air. This system is also expensive to run. Another and a better solution to the dust problem is treatment of the airlaid material during manufacture in order to reduce the development of dust to such an extent that dust problems do not occur during converting.

Airlaid products bonded with thermal bonding fibers have different properties from products made solely with binding agent sprayed onto the web. For products with thermal bonding fibers, there is no delamination limit because the fibers are homogeneously distributed throughout the product. For instance, it is possible to manufacture a product of 1000 g/m$^2$. It is not necessary to compact the web very much, and the cellulose fibers are not coated with binders.

Because of their good absorption properties, thermally bonded airlaid products made from cellulose derived from wood, often together with other additives such as superabsorbent, are mainly used as functional shields inside hygienic products such as sanitary napkins, incontinence products, etc.

Airlaid products made from cellulose derived from wood bonded with thermally activated bonding fibers, however, have a disadvantage compared to binder bonded products. Because wood cellulose has a large content of very short fibers, and also because, for economic and quality reasons, no more than 15 to 25% of thermally activated bonding fibers are used, the cellulose fibers are not bonded 100%. Therefore, the products have a tendency to release fibers (i.e., lint) when exposed to stretching and vibration during further handling.

It has been thought to avoid dusting by using a higher percentage of binder fibers of different lengths, this solution is hardly realistic from a production standpoint.

SUMMARY OF THE INVENTION

It is an object of the present invention to overcome the aforesaid deficiencies in the prior art.

It is another object of the present invention to eliminate fiber dusting during web production.

It is a further object of the present invention to provide a method of manufacturing a dryformed fibrous web material from dryformed cellulose fibers.

It is still another object of the present invention to provide a web made by suitably bonding cellulose fibers.

The process of the present invention provides a web and a method of making the web by using a combination of the two above-mentioned methods, although with the binder in a modified form.

As noted above, in the bonding method the bonding of fibers in the web is best at the surface of the web and poorest at the center of the web. However, if conventional bonding is combined with the use of thermobonding fibers, the bonding per se seals against dusting of the fibers, so that only a very thin surface layer of bonding material is needed to coat the surface of the web. The web material is held together by activating the thermobonding fibers, and a surface binder is applied simultaneously onto both sides of the already self-supporting web. Both of the applied binder layers, which can be extremely thin and still be effective, can be hardened by passing them through a single additional heating zone with relatively low capacity. When the surfaces of the web material are thus coated with a thin layer of binder, the web is sealed against extrusion of the short cellulose fibers from the web material. This is exactly the result desired.

Thus, by using the process of the present invention, there is no dependence on any increased local bonding of the fibers, although the effect may partly depend upon the occurrence of increased fiber binding in the surface of the web, wherein there is to a lesser degree a question of actually coating the surface of the web.

It is thus a main feature of the present invention to produce webs by finer bonding wherein the webs are made of admixed thermobonding fibers. The web surfaces are sealed to a greater or lesser extent by adding binder in modest amounts, without any requirement to provide deep penetration of the binder into the web material. However, according to the present invention, it is important to indicate how the binder can be applied in a new and very economical way to achieve the desired result.

In one embodiment of the invention, the binder is applied in a foamed condition, whereby it covers the surface of the web with a minimum of dry matter therein. This treatment provides the optimum result, namely, that by using small amounts of both liquid and dry matter, the short fibers in the surface are bonded, so that these short fibers remain in place and partially assist in sealing against extrusion of the short and unbonded fibers form the inside of the web material. The web material remains light and porous so that, for instance, it is well suited for making impregnated moist tissues.

A desirable effect can be achieved by admixing only about 1–2 g. of binder per m$^2$ per side, using a water dispersed foamed binder with only about 2 g. of dry pulp per liter of foam. The foam may be generated in a conventional foaming unit, and the binder may then be present in the foamed volume in an amount of only about 0.2 volume percent. Thus, there is very little water to be removed from the product, and drying and hardening of the binder may be effected with a fairly low energy consumption in the hardening zone.

The foam may be applied in any suitable manner, e.g., by vertical, sloping, or horizontal feeding of the web through mating rollers, with a controlled foam supply to the roller gap on both sides of the web. Rolling the web yields a smooth and firm surface, with the surface fibers bonded in couched positions.

The penetration depth of the prefoamed binder can be controlled by means of admixed moisturizing agents. This is important, as insufficient penetration depth results in abradement of the thin bonding layer of the surface. Too great a penetration depth causes an unnecessarily large amount of binder to be used, and results in a product exhibiting sluggish water absorption.

It is also possible to apply the binder onto the thermobonded, airlaid material by means of other application devices, e.g., atomization nozzles, as long as the penetration depth is kept under control. However, application according to this method yields a less homogeneous product than does foam application.

As mentioned above, the binder can dry out and be hardened with a fairly low consumption of energy. However, hardening and drying of the binder can be conducted at such a high temperature that the bonding fibers are reactivated. As explained below, this results in a doubling of the tensile strength of the web.

The present invention provides for the manufacturing of products with desired characteristics that are maintained despite successive extrusion of the short fibers from these products. As this amount of extruded fiber in a given manufacturing process may be considerable, the methods of the present invention represent a significant improvement over prior art in achieving the desired characteristics of the finished product.

In a further embodiment of the invention the admixture of airlaid thermobonding fibers is controlled such that there is a gradual increase in the fiber concentration nearer the surface of the product. In one particular product, the surface layer may have such a concentration of thermobonding fibers so as to simulate traditional, non-woven textiles in appearance and behavior.

DETAILED DESCRIPTION OF THE INVENTION

Figure 1:
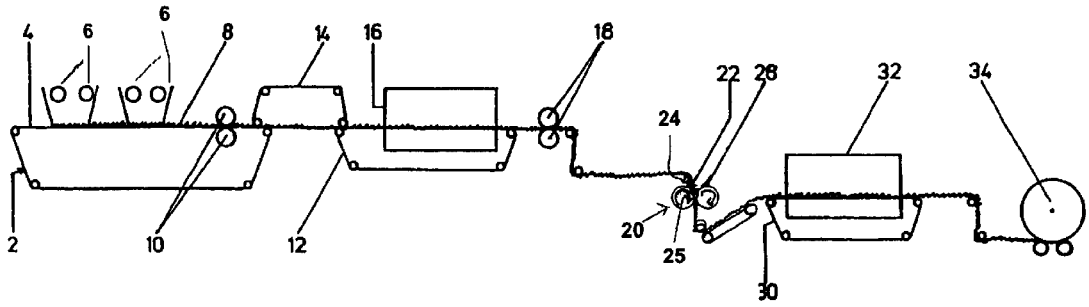
FIG. 1 illustrates the manufacture of a fibrous web according to the present invention.
Figure 2:
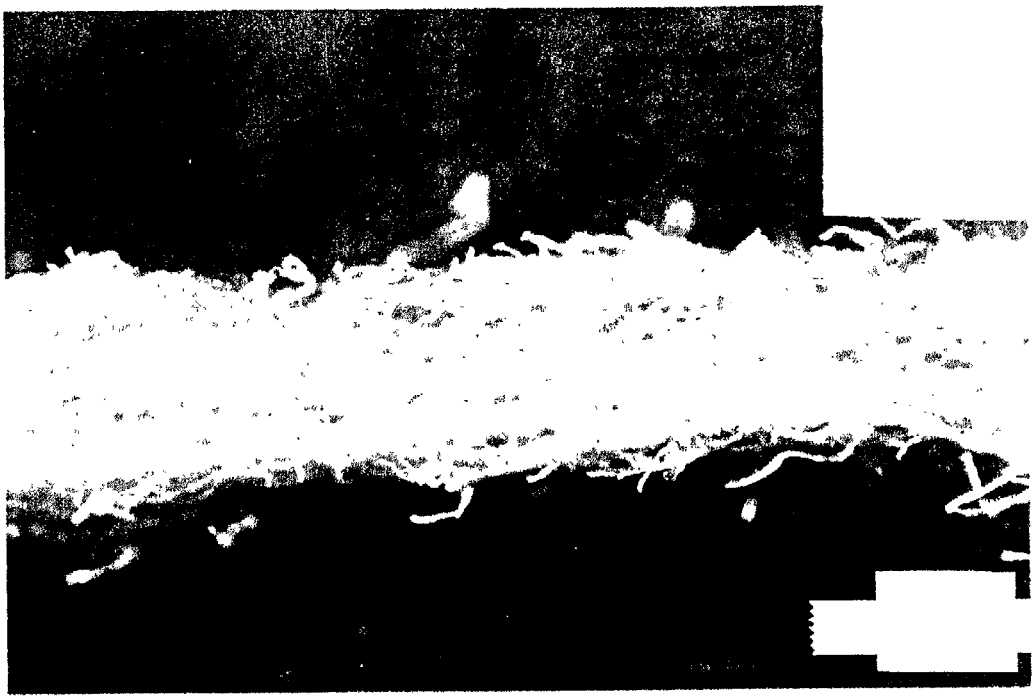
FIG. 2 shows the product of FIG. 2, wherein only the binder (and not the cellulose fibers), have been treated with a coloring agent.
Figure 3:
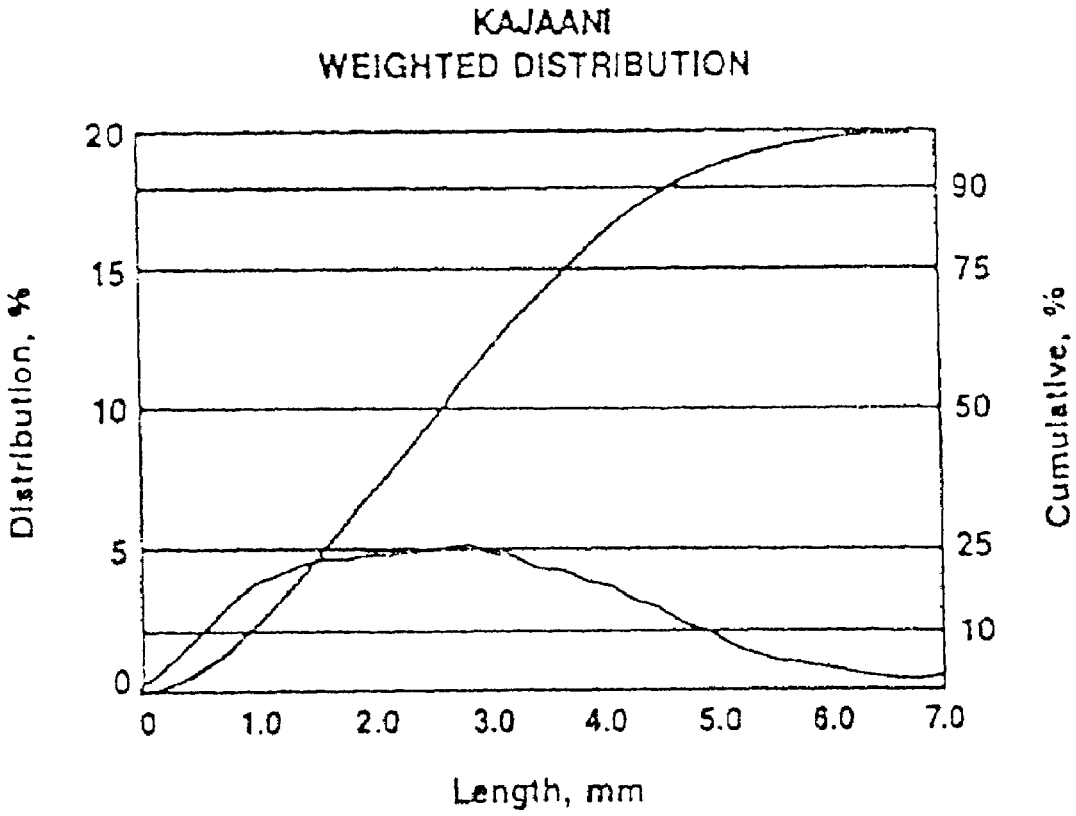
FIG. 3 shows the fiber distribution in wood cellulose.
Figure 4:
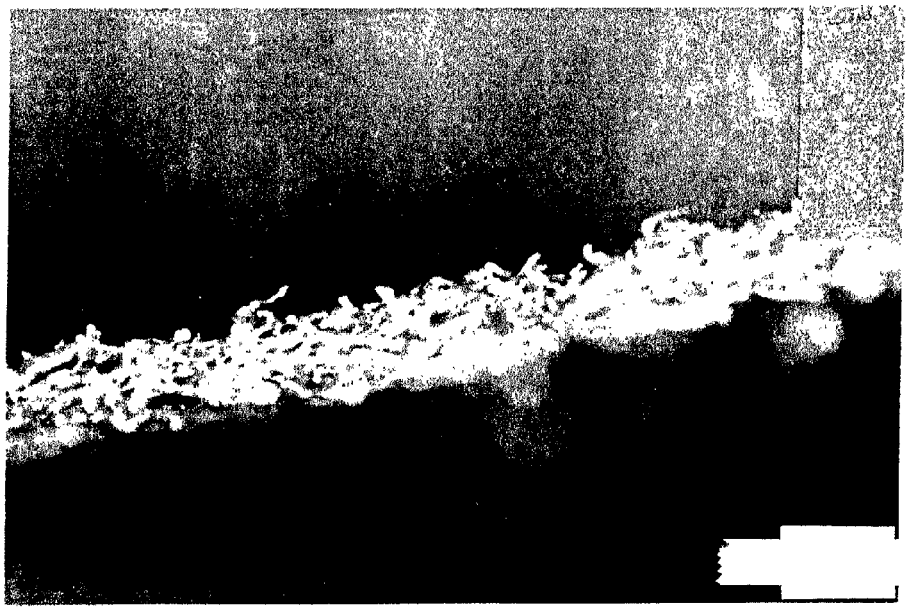
FIG. 4 illustrates foam coated sample wherein the binder has been dyed with green pigment.

A preferred embodiment of the present invention is shown schematically in FIG. 1. A wire screen (2) is shown having a conveyor belt or apparatus (4) below a pair of distributor heads (6) that apply a mixture of loose cellulose and heat thermobonding fibers to the apparatus (4). A loosely-formed web (8) results. This loose web is then compressed between rollers (10) and transferred to a transport wire (12) via an overhead transfer station (14). The transport wire (12) carries the web (8) through a heating zone (16), which activates the thermobonding fibers to bond the loose cellulose. Preferably, the temperature in the heating zone (16) is maintained between 130–140 degrees Celsius.

The newly bonded web (22) is now stabilized and self-supporting. It is carried first through conventional mating rollers (18) and then taken to a downstream station (20) where it is treated on both sides with a binder foam. Preferably, foam treatment is accomplished by leading the web (22) down and around a diversion roller (24) to a foulard unit comprised of a pair of adjustably-spaced rollers (26) equipped with means (not shown) to add impregnating compounds (28) to both sides of the web (22).

The web (22) now passes onto a conveyor belt (30) which takes it through a heating tunnel (32). Here, the web is heated, preferably by hot air, to evaporate the aqueous components of the binder foam. The processed web (22) is then reeled up by conventional delivery rolls (34).

It is possible to control the supply of the impregnating compound both by adjusting the gap between the adjustably-spaced rollers (26) and by regulating the flow of the compound. For example, the gap between rollers (26) may range from 2–20 cm.

Additionally, the amount of dry matter in the bonding agent may be adjusted, for example, between about 0.5 to about 15%. The foam density may also be varied, between about 20 and 100 g/L.

The hardness or softness of the product may be controlled by choosing a binder agent which forms a hard or soft film, respectively. The hydrophilic or hydrophobic nature of the product may be controlled according to the use of suitable preforming agents or additives.

Surprisingly, it has been demonstrated that using a suitably high temperature in the heating tunnel (32), i.e., a temperature between 130 and 140 degrees Celsius, results in efficient water evaporation of the aqueous elements of the foam and, more significantly, improves the tensile strength of the processed web by about 25–100%. This improvement cannot be explained by the very modes supply of binder applied to the outer sides of the web (22), but must instead result from maintaining the temperature in the heating tunnel between 130 and 140 degrees Celsius.

When the unformed web materials (8) pass through the first rollers (10), they are pressed against the wire screen (2). Specifically, the wire screen consists of a woven grid of intersecting wires or monofilaments which, by means of their associated intersections, form local, depressed or upwardly protruding areas in the web (8). The protruding areas will necessarily be compressed to a lesser degree than those areas which constitute a depression. Furthermore, the areas of depression will exhibit greater sensitivity to the welding effect that occurs as the web (8) passes through the heating zone (16). However, this discrepancy is mitigated somewhat by the fact that the web, while passing through the transfer unit (14), becomes somewhat loosened, as a result of the weak tensile force and web movement inherent in removal of the web fibers (8) from the wire screen (2). Additionally, the compressed web possesses a certain expansion capability, such that fibers originally forming areas of depressions will be substantially less-compacted by the time they reach the hardening tunnel (16).

However, when the processed web (22) passes station 20, a new web compression occurs. Correspondingly, there is an increase in the coherence of the surface layers of the web. Furthermore, passage of the web through the oven unit (32) results not only in evaporation of the aqueous elements of the foamed binder, but also produces renewed heat activation of the thermobonding fibers. Preferably, the oven unit (32) is maintained at approximately the same temperature as the heat tunnel (16), i.e., between 130 and 140 degrees Celsius. In this manner, the heat treatment of the web provides a means for significantly increasing the tensile strength of the final web product.

The present invention thus results in the bonding or sealing of the dusting fibers under a non-sealed surface. This is advantageous in that the fibers within the fixed surface layers possess a significant fluid spreading effect, of significant import in absorbent products. Furthermore, in many of these absorbent products, fluid need be absorbed by only a sub-area of the entire product (e.g., the crotch area of diapers). It is desirable, then, to use a superabsorbent in this most "active" sub-area. However, if the entire product can be manufactured, as with the present invention, to distribute liquid more evenly throughout the product, use of a superabsorbent can be minimized.

With respect to the present invention, it is necessary to emphasize that the binder may be applied to both sides of a product having a center layer of superabsorbent material, without said superabsorbent material having to become activated by water. For example, the product may have a bottom fiber layer of 70 g/m$^2$, an intermediate layer of superabsorbent of 30 g/m$^2$, and a topmost fiber layer of 30 g/m$^2$.

The present invention is also advantageous in that it reduces dusting and exhibits a sustained content of shorter fibers.

The present invention enables the bonding foam to be used as a carrier for coloring pigments, said pigments being added prior to foaming. However, as the binder is normally used in very modest amounts, only pastel colors may be achieved unless the process is specifically adapted for more powerful and concentrated dyeing.

By applying an increased amount of binder, e.g., 10%, the present invention makes it possible to foam coat a thermally bonded air laid product containing only a small percentage of binding fibers, e.g., about 5%, although the thermobonding fibers cancomprise up to about 35% of the total fiber content. This permits the manufacture of a predominantly latex-bonded product without the necessity of adding binder via traditional spraying techniques. Indeed, according to the present invention, the same abrasion resistant surface may be achieved but without the associated limitation on web thickness inherent in traditional spray binding techniques. (Usually, traditional spray binding techniques necessitate webs less than about 100–120 g/m$^2$) Thus, low density products with a relatively high weight per square meter can now be manufactured. According to the present invention, thicker products will hold a noticeably increased amount of cellulose fibers not covered by a film of binding agent, resulting in optimum absorption capability.

From a process point of view, it is advantageous that the binding agent be applied only at one point in the manufacture, rather than at multiple stations as is practiced in the prior art. Furthermore, it is most advantageous to avoid the traditional spraying stations, which result in numerous operational and maintenance problems. In contrast, the foulard unit contemplated in the present invention proves far easier to maintain. Additionally, it provides consistent, even, and efficient foam application.

However, other foam application techniques may be used in accordance with the present invention. Screen-coating, for example, may be employed with satisfactory results.

The thermobonding fibers can comprise from about 1–40% of the total fiber content of the web. The amount of dry matter applied to the surface of the web id from about 0.5 to about 40 grams of dry matter per square meter of web surface. However, the amount of dry matter in the binder and the amount of thermobonding fibers can be adjusted to produce a web having the desired characteristics. In one embodiment of the present invention, the web comprise about 20–35% thermobonding fibers, and the amount of binder applied to the surface of the web is about 0.5–5.0 grams per square meter of web surface.

In another embodiment of the present invention, the web comprises about 3–7% of thermobonding fibers, and the amount of fiber applied to the surface of the web is about 5–20 grams per square meter of web surface.

The airlaid fibrous webs of the present invention can also be used to produce composites comprising layers of the fibrous webs of the present invention with other types of materials. For example, the web material can be part of a composite product where the outer layer of the composite is the web material made according to the present invention. These composites can also include a layer of a superabsorbent material, preferably where the outer layer is the web of the present invention.

Figure 6:
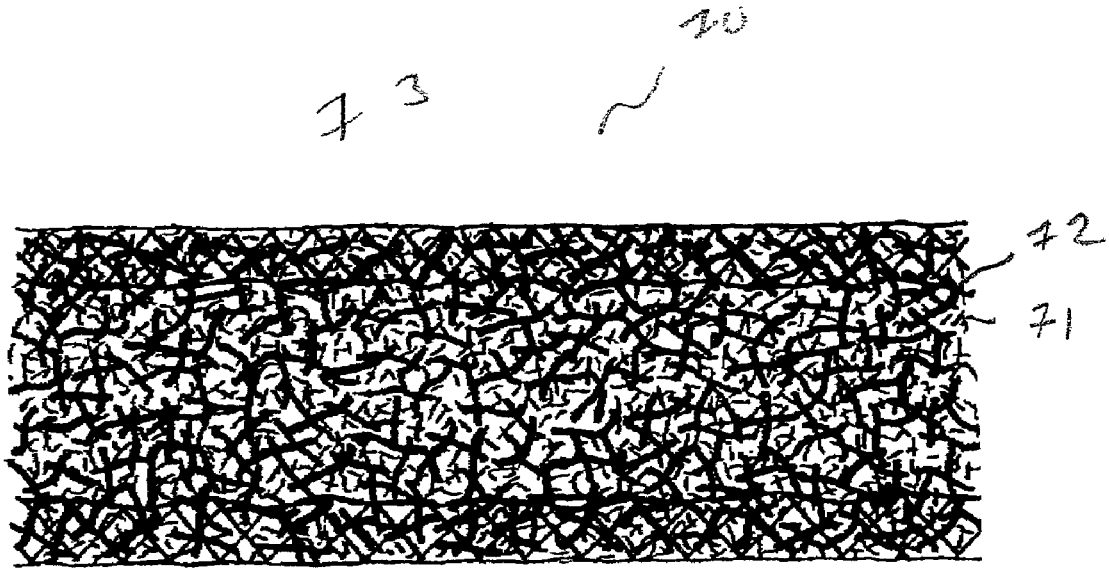
FIG. 6 provides a general diagram of the principle of binding as contemplated by the present invention.

FIG. 6 shows a cross section of a product 70 produced according to the invention comprising cellulose fibers 71, thermobonding fibers 72, and bonding agent 73. The central portion of the product is comprises of a mixture of wood cellulosic fibers 71 and thermobonding fibers 72 (heavier lines), which create a network which holds the product together. Closer to the surfaces of the product, there is a somewhat defined borderline, which is the depth to which the aqueous binder has penetrated and from which the water has evaporated, leaving only the binding action. The outer portion of the product consists of all three constituents. Optionally, a superabsorbent in particulate form may be incorporated in the center of the product.

EXAMPLE 1

Manufacture of an Airlaid Product, 150 g/m$^2$, with a Relatively Low Content of Thermobonding Fibers and a Relatively High Content of Binder on the Surfaces of the Product On a fiber web consisting of 95.5% softwood cellulose *type Rayfloc-XJ) and 5.5% thermobonding fibers (type ES-C 1.7 dtex×6 mm) was formed on a forming wire and a layer of water-dispersed binder was applied onto the top surface.

After drying in an oven, a layer of binder was also applied to the bottom surface of the web.

After additional passage through an oven, the product was dried and the thermally bonding fibers had also become activated.

For the application of the binder dispersion an air atomisation nozzle was used, as these nozzles make it easier to control the drop size of atomized binder as well as the penetration depth of the binder into the product.

The penetration depth of the binder is adjusted in such a way that the binder is mainly placed on the surface of the product.

The qualities of the product approximately correspond with the qualities of a traditional latex bonded airlaid product, however with the decisive difference that it does not delaminate.

The product can advantageously be used as core for panty shields, draw sheets and bibs (laminated with PE-foil), and similar products where a good absorption of liquids is required.

The binder used for bonding of the surfaces of the product had the following composition:

22% Sarpifan WGR

78% water

| Product data: | |
|---|---|
| Binder, top surface | 5.0% |
| Pulp | 85.0% - homogeneously distributed |
| Thermobonding fibers | 5.0% - homogeneously distributed |
| Binder, bottom surface | 5.0% |
| Weight | 150.0 g/m$^2$ |
| Thickness | 1.5 mm |
| Tensile strength, MD | 2200.0 g/50 mm |
| Linting | 0.1–0.2 mg |
| Water absorption | 8.0 g/g |

EXAMPLE 2

Manufacturing of a Binder Coated, Thermobonded Airlaid Product Containing Super Absorbent Powder (SAP)

A web containing 80% softwood fibres and 20% thermobonding fibers, and which has a weight of 65 g/m$^2$, is formed on a forming wire.

Then a dispenser distributed 30 g SAP per m$^2$ onto the web.

A large part of the SAP penetrates into the fiber web and thus becomes integrated into the fiber layer.

On top of the SAP an additional fiber layer of 45 g/m$^2$ is formed with the same fiber composition as mentioned above.

After a light compacting the formed web is conveyed to the oven where it is heated and the bonding fibers activated, thus bonding the formed web with SAP into a matted product.

The product is then conveyed to the foulard where both sides will be coated with the foamed, water-dispered binder.

As the foamed binder does not penetrate deeply into the product, the super absorbent powder, which is placed in the middle of the product, will only become slightly humidified. In this way the difficult re-drying of liquid from the SAP is avoided.

At the subsequent drying of the product in the oven the vaporized water from the surface of the products will become sucked through the product. The vapor will make the SAP grains become a little sticky on the surface and thus a partial fixation of the SAP grains in the product is obtained. After drying, the product is wound onto reels.

The product has a low linting and due to its good liquid absorption and liquid retention qualities, it is mainly used as the functional core in sanitary towels, incontinence products etc.

The binder recipe used for foam coating of the surface:

| | |
|---|---|
| 16.5% | Sarpifan WGR |
| 0.2% | Rohagal 10 n |
| 83.3% | Water |

Foam density: 20 g/l

| Product Data: | | |
|---|---|---|
| Binder, top surface | 2.5 g/m$^2$ | |
| Fibers, top | 45.0 g/m$^2$ | - mixture of wood pulp and thermobinding fibers |
| SAP | 30.0 g/m$^2$ | |
| Fibers, bottom | 65.0 g/m$^2$ | - mixture of wood pulp and thermobinding fibers |
| Binder, bottom surface | 2.5 g/m$^2$ | |
| Wegiht | 145.0 g/m$^2$ | |
| Tensile strength, MD | 2000.0 g/50 mm | |
| Absorption, saline 0.9% | 16.0 g/g | |
| Linting | 0.5 mg | |

In principle, the binder foam may be applied to the web before the web is thermally fixed. In this case, it may be sufficient to utilize a single heating zone for actuating both the binding fibers and the binding agent. The following examples are provided to more clearly demonstrate the possible embodiments of the present invention. These examples, however, are not intended to limit the scope of the present invention in any way.

EXAMPLE 3

Manufacture of a Foam-coated, Hydrophilic Product

An air-laid product, 60 g/m$^2$, consisting of about 85% wooden cellulose fibers with the largest possible content of long fibers, and 15% thermobonding fibers, was foam-coated in a foulard, the roller gap of which was adjusted to 0.6 mm. The prefoamed binding agent was produced in the following manner:

Binder mix specification:

11.1% Sarpifan WRG (Stockhausen, DE)
0.2% rohagal 10 n (Rohm GmbH, DE)
88.7% water The binding agent was foamed to a density of 20 g/L.

If the foam level in the foulard is maintained at about 4 cm, then approximately 1.5 g. binder (100% drystuff) is added, to each side, for each m$^2$ of product.

After foam coating, the product was dried according to conventional methods, at a temperature of approximately 140 degrees Celsius.

EXAMPLE 4

Manufacture of a Foam Coated, Hydrophobic Product

This product was manufactured in the same manner as Example 1, above, but utilized a different binder mix.

Binder mix specification:

11.1% Sarpifan WRG (Stockhausen, DE)
2.0% Stokal STA (Stockhausen, DE)
86.9% water It has been discovered that linting in webs formed with thermobonding fibers can be substantially eliminated by placing on the surface of the product a very thin, homogeneous layer of binder.

When a binder dispersion is foamed to about 20 g/L (20 volume parts of binder dispersion and 980 volume parts of air), the foam is very stiff, exhibiting a consistency similar to whipped egg white. The binder in this state does not penetrate very deeply into the product. However, there do exist alternative means of application equipment, as noted above, which can apply a sufficient quantity of binder to the product surface.

Figure 5:
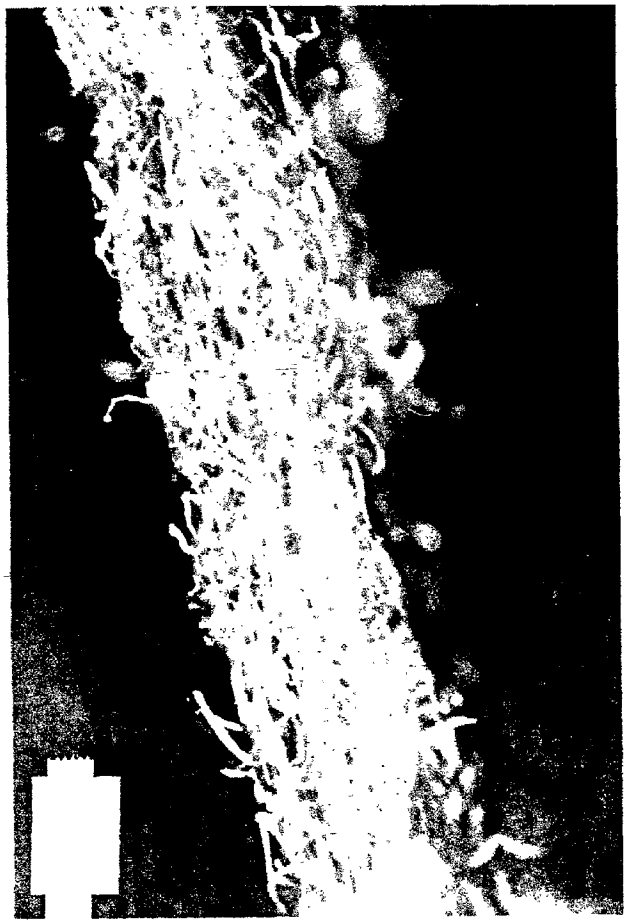
FIG. 5 depicts samples wherein only the binder has been treated with coloring agent(s).

In order to document that the bonding layer in products bonded by heat activated bonding fibers is, indeed, placed onto the surface of the product, FIG. 5 illustrates a foam coated sample. In this sample, the binder was dyed with a green pigment to show how the binder is distributed in the airlaid product. FIG. 6 shows two micro photos illustrating a sectional view of the product of the present invention. The sample is dyed with a coloring agent that colors only the binder. Here, it is evident that the binder is placed only on the surface of the products. The fact that the green color in FIG. 5 is visible through the white fibers in the middle of the product indicates that the green bonding layer appears thicker than it actually is.

The content of the binder in the product in these examples is too small to be determined via traditional analysis methods. However, the amount of binder can be calculated quite accurately according to the fiber flow in the foam mixer, the content of dry matter, the web width, and the line speed.

The green dyed product of FIG. 5, for example, was produced from 85% Rayfloc-X-J wood cellulose pulp from ITT Rayonier, USA; ES-C 1.7 dtex×6 mm. thermal bonding fibers from Danaklon, DE, at a temperature of 142 degrees Celsius, with approximately 1.75 g/m2 binder applied to each side of the product. The product weight was found to be 88 g/m2. The binder used for coating the product included the following components:

| | |
|---|---|
| Water | 84.6% |
| Vinamul 3301 ethylene vinyl acetate dispersion binder (Vinamul, UK) | 15.4% |
| Rohagal 10n foaming agent (Rohm, Germany) | 0.2% |
| Pigment dispersion (green), for textile printing (Diazo Kemi, Denmark) | 0.2% |

In order to demonstrate the effect of surface coating on the linting characteristics of the product, two webs produced according to the present invention were tested for linting. The product compositions were as follows:

| | |
|---|---|
| Product A: | |
| Rayfloc-X-J | 85% |
| ES-C 1.7 dtex × 6 mm | 15% |
| Weight | 85 g/m$^2$ |
| Product B: | |
| Rayfloc-X-J | 85% |
| ES-C 1.7 itex × 6 mm | 15% |
| 1.75 g/m$^2$ binder on each side | |
| Weight | 89 g/m$^2$ |

Test samples were cut to a length of 130 mm. in the CD direction and 300 mm. in the MD direction. The test samples were conditioned for 24 hours at a relative humidity of 60%. Each sample was then weighed on an analytical scale with an accuracy of ±0.1 mg. Testing commenced immediately after recordation of the product weights.

The two short sides of the samples were fastened by two clamps spaced 270 mm apart. One clamp remained in a fixed position. The other, movable clamp, weighed 11 g. and exhibited a force of 0.25 Newton. The movable clamp was then moved 2450 mm toward the fixed clamp. When released, the movable clamp migrated toward the point of departure until stopped by the fastened sample. The sample was, then, somewhat stretched, but within its limits of elasticity.

At the same time, the sample was briefly subjected to vibration. The mobile clamp was moved 50 times. The loose cellulose fibers on the surface of the product were released from the product and allowed to fall off. The sample was then removed from the clamps and weighed again on the analytical scale. Weight loss corresponded to the quantity of lint released during testing. The following table summarizes the lint loss exhibited by the two types of samples:

| | | | |
|---|---|---|---|
| Product A | Product bonded with heat activated bonding fibers | Weight loss (linting) in mg: 19.5 19.5 18.4 18.9 | Average: 19.0 |
| Product B | Product as above, but with approximately 1.75 g/m$^2$ binder on each side of Product A | Weight loss (linting) in mg: 0.4 0.2 1.1 0.8 0.1 | Average: 0.52 |

The linting from the surface coated products (Product B) was reduced to less than 3% as compared to the uncoated products (Product A).

The foregoing description of the specific embodiments will so fully reveal the general nature of the present invention that others skilled in the art can, by applying current knowledge, readily modify or adapt for various applications such specific embodiments without undue experimentation and without departing from the generic concept, and therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of forms without departing from the invention.

Thus, the expressions "means to . . . " and "means for . . . ", or any method step language, as may be found in the specification above and/or in the claims below, followed by a functional statement, are intended to define and cover whatever structural, physical, chemical, or electrical element or structure, or whatever method step, which may now or in the future exist which carries out the recited functions, whether or not precisely equivalent to the embodiment or embodiments disclosed in the specification above, i.e., other means or steps for carrying out the same function can be used; and it is intended that such expressions be given their broadest interpretation.

What is claimed is:

1. A process for manufacturing an absorbent dryformed paper web having a plurality of layers, with an optional center layer containing a superabsorbent material comprising:

a. laying a web of cellulose fibers, admixed with thermobonding fibers, onto a forming wire, wherein the thermobonding fibers comprise about 3–25 wt % of the total fiber content, wherein the thermobonding fibers are distributed such that there is a gradual increase in thermobonding fiber concentration nearer the surface of the web;

b. applying a binder to form binder layers on the top surface and bottom surface of the web of cellulose fibers, wherein the amount of dry matter in the binder is from about 0.5–15 wt % and the amount of dry matter applied to the surface of the web is from about 0.5–20 g. of dry matter per square meter of web surface; and c. heating the web to a temperature sufficient to melt the thermobonding fibers and increase the tensile strength of the finished product.

2. The process according to claim 1 wherein the amount of dry matter in the binder is from about 0.5–15 wt %.

3. The process according to claim 1 wherein the binder is applied in an amount of about 0.5–10 grams dry matter per square meter of web surface.

4. The process according to claim 1 wherein the binder is an aqueous binder.

5. The process according to claim 1 wherein the binder contains pigments admixed therewith.

6. The process according to claim 2 wherein said web comprises about 10–25 wt % thermobonding fibers and the amount of binder applied to the surface of the web is about 0.5–10 grams per square meter of web surface.

7. The process according to claim 2 wherein said web comprises about 3–7 wt % of thermobonding fibers and the amount of binder applied to the surface of the web is about 5–20 grams per square meter of web surface.

8. A process for manufacturing an absorbent dryformed paper web having a plurality of layers, comprising:

a. laying a web of cellulose fiber, admixed with thermobonding fibers, onto a forming wire, wherein the thermobonding fibers comprise about 3–25 wt % of the total fiber content, wherein the thermobonding fibers are distributed such that there is a gradual increase in the thermobonding fiber concentration nearer the surface of the the web;

b. applying a binder to the top surface and to the bottom surface of the web of cellulose fibers to form a binder layer on the top surface and on the bottom surface of the web of cellulose fibers, wherein the amount of dry matter in the binder is from about 0.5–15 wt % and the amount of dry matter applied to the surface of the web is from about 0.5–20 g of dry matter per square meter of web surface; and c. heating the web to a temperature sufficient to melt the thermobonding fibers to provide sealing of dusting fibers under the surface of the binder and increase the tensile strength of the fiber product.

9. The process according to claim 8 wherein the web of cellulose fibers contains a super-absorbent material.

10. The process according to claim 8 wherein the binder is applied as a foam.

* * * * *